US012497870B2

(12) United States Patent
Eitschberger et al.

(10) Patent No.: US 12,497,870 B2
(45) Date of Patent: Dec. 16, 2025

(54) BALLISTICALLY SAFE WELLBORE TOOL

(71) Applicant: DynaEnergetics Europe GmbH, Troisdorf (DE)

(72) Inventors: Christian Eitschberger, Munich (DE); Thilo Scharf, Letterkenny (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/939,043

(22) Filed: Nov. 6, 2024

(65) Prior Publication Data

US 2025/0059860 A1 Feb. 20, 2025

Related U.S. Application Data

(63) Continuation of application No. 18/553,427, filed as application No. PCT/EP2022/060784 on Apr. 22, 2022, now Pat. No. 12,163,406.

(60) Provisional application No. 63/179,791, filed on Apr. 26, 2021.

(51) Int. Cl.
*E21B 43/1185* (2006.01)
*F42D 1/04* (2006.01)

(52) U.S. Cl.
CPC ..... *E21B 43/11855* (2013.01); *F42D 1/04* (2013.01)

(58) Field of Classification Search
CPC ..... F42D 1/04; F42D 5/00; E21B 43/11855
See application file for complete search history.

(56) References Cited

U.S. PATENT DOCUMENTS

| | | | | |
|---|---|---|---|---|
| 2,889,775 | A | 6/1959 | Owen | |
| 4,007,796 | A | 2/1977 | Boop | |
| 5,027,708 | A | 7/1991 | Gonzalez et al. | |
| 5,159,145 | A | 10/1992 | Carisella | |
| 7,387,156 | B2 | 6/2008 | Drummond et al. | |
| 7,487,833 | B2 | 2/2009 | Grigar et al. | |
| 8,256,337 | B2 | 9/2012 | Hill et al. | |
| 9,222,339 | B2 | 12/2015 | Mason et al. | |
| 9,689,239 | B2 | 6/2017 | Hardesty | |
| 11,733,008 | B1 * | 8/2023 | Burnsed, Jr. | F42B 3/26 102/275.12 |
| 2004/0216632 | A1 | 11/2004 | Finsterwald | |
| 2008/0276818 | A1 * | 11/2008 | Ballantine | F42D 1/043 102/202.1 |
| 2012/0199352 | A1 | 8/2012 | Lanclos et al. | |

(Continued)

OTHER PUBLICATIONS

European Patent Office; International Search Report and Written Opinion issued in PCT/EP2022/060784 on Aug. 1, 2022; 10 pages.

(Continued)

*Primary Examiner* — J. Woodrow Eldred
(74) *Attorney, Agent, or Firm* — Womble Bond Dickinson (US) LLP

(57) ABSTRACT

A ballistically-safe wellbore tool may include an explosive device, an initiator including an initiating charge, and a bias member. A relative configuration of the explosive device and the initiator may be switchable between a first configuration, in which the initiating charge is at a ballistically safe distance from the explosive device, and a second configuration, in which the initiating charge is within a ballistically operable distance from the explosive device. The bias member is configured to bias the explosive device and the initiator to the first configuration.

20 Claims, 9 Drawing Sheets

(56) References Cited

U.S. PATENT DOCUMENTS

| | | | | |
|---|---|---|---|---|
| 2012/0247771 | A1 | 10/2012 | Black et al. | |
| 2013/0125772 | A1 | 5/2013 | Backhus et al. | |
| 2019/0234189 | A1 | 8/2019 | Preiss | |
| 2021/0048284 | A1 | 2/2021 | Maxted et al. | |
| 2022/0049936 | A1 | 2/2022 | O'Brien | |
| 2022/0145732 | A1 | 5/2022 | Anthony et al. | |
| 2024/0003231 | A1 | 1/2024 | Gartz | |
| 2024/0183251 | A1* | 6/2024 | Eitschberger | F42D 1/04 |

OTHER PUBLICATIONS

Petroleum Services Association of Canada, Guidelines for the Safe Operation of Tubing Conveyed Perforating Systems, WorkSafe Alberta, May 2007, 21 pages.
United States Patent and Trademark Office, non-final Office Action for U.S. Appl. No. 17/951,606 dated Jan. 17, 2023, 11 pages.
United States Patent and Trademark Office, final Office Action for U.S. Appl. No. 17/951,606 dated Apr. 27, 2023, 10 pages.
United States Patent and Trademark Office, non-final Office Action for U.S. Appl. No. 17/951,606 dated Aug. 17, 2023, 12 pages.
United States Patent and Trademark Office, Notice of Allowance for U.S. Appl. No. 17/951,606 dated Jan. 8, 2024, 9 pages.
United States Patent and Trademark Office, Notice of Allowance for U.S. Appl. No. 17/951,606 dated Feb. 22, 2024, 2 pages.
United States Patent and Trademark Office, non-final Office Action for U.S. Appl. No. 18/193,874 dated Aug. 3, 2023, 7 pages.
United States Patent and Trademark Office, final Office Action for U.S. Appl. No. 18/193,874 dated Nov. 30, 2023, 9 pages.
United States Patent and Trademark Office, Notice of Allowance for U.S. Appl. No. 18/193,874 dated Mar. 28, 2024, 10 pages.
United States Patent and Trademark Office, Notice of Allowance for U.S. Appl. No. 18/193,874 dated Jun. 25, 2024, 2 pages.
United States Patent and Trademark Office, Notice of Allowance for U.S. Appl. No. 18/553,427 dated Apr. 18, 2024, 7 pages.
United States Patent and Trademark Office, Notice of Allowance for U.S. Appl. No. 18/553,427 dated May 3, 2024, 2 pages.
United States Patent and Trademark Office, Notice of Allowance for U.S. Appl. No. 18/553,427 dated Aug. 6, 2024, 5 pages.

* cited by examiner

BALLISTICALLY SAFE WELLBORE TOOL

CROSS-REFERENCE TO RELATED APPLICATIONS

This application is a continuation of U.S. application Ser. No. 18/553,427 filed Sep. 29, 2023, which is a national stage entry of International Application No. PCT/EP2022/060784 filed Apr. 22, 2022, which claims priority to U.S. Provisional Application No. 63/179,791 filed Apr. 26, 2021, the entire contents of each of which are incorporated herein by reference.

BACKGROUND

Hydrocarbons, such as fossil fuels (e.g. oil) and natural gas, are extracted from underground wellbores extending deeply below the surface using complex machinery and explosive devices. Once the wellbore is established by placement of casing pipes after drilling and cementing the casing pipe in place, a perforating gun assembly, or train or string of multiple perforating gun assemblies, are lowered into the wellbore, and positioned adjacent one or more hydrocarbon reservoirs in underground formations.

Assembling and running a wellbore tool string can be an expensive and time-intensive undertaking. Additionally, errors during the assembly process may cause the tool string to fire prematurely or misfire when deployed in the wellbore, creating a safety risk for personnel, as well as causing significant loss of money and time. Accordingly, it may be beneficial to pre-assemble as much of the tool string as possible in the factory before the equipment arrives at the wellbore site.

However, because of safety concerns, government regulations may limit how much of the tool string can be assembled before shipping. In particular, there are many limitations and prohibitions related to the shipping of ballistically armed wellbore tools such as perforating guns. Accordingly, perforating guns may be shipped without an initiator or detonator installed, in order to ensure that the perforating gun is not ballistically armed. This results in additional work that must be performed at the wellbore site related to the insertion, connection, and arming of initiators/detonators.

Accordingly, it may be beneficial to develop a system in which the initiator is provided within the wellbore tool prior to shipment, yet the explosives within the wellbore tool remain ballistically unarmed.

BRIEF SUMMARY

An exemplary embodiment of a ballistically-safe wellbore tool may include an explosive device, an initiator including an initiating charge, and a bias member. A relative configuration of the explosive device and the initiator may be switchable between a first configuration, in which the initiating charge is at a ballistically safe distance from the explosive device, and a second configuration, in which the initiating charge is within a ballistically operable distance from the explosive device. The bias member is configured to bias the explosive device and the initiator to the first configuration.

An exemplary embodiment of a method of arming an explosive device in a wellbore tool may include providing a first module including an explosive device, an initiator comprising an initiating charge, and a bias member. A relative configuration of the explosive device and the initiator may be switchable between a first configuration, in which the initiating charge is at a ballistically safe distance from the explosive device, and a second configuration, in which the initiating charge is within a ballistically operable distance from the explosive device. The bias member may be configured to bias the explosive device and the initiator to the first configuration via a biasing force. The method may further include arming the first module by coupling a second module to the first module. The arming the first module may include ballistically arming the first module by providing a coupling force to act against the biasing force such that the explosive device and the initiator transition from the first configuration to the second configuration.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
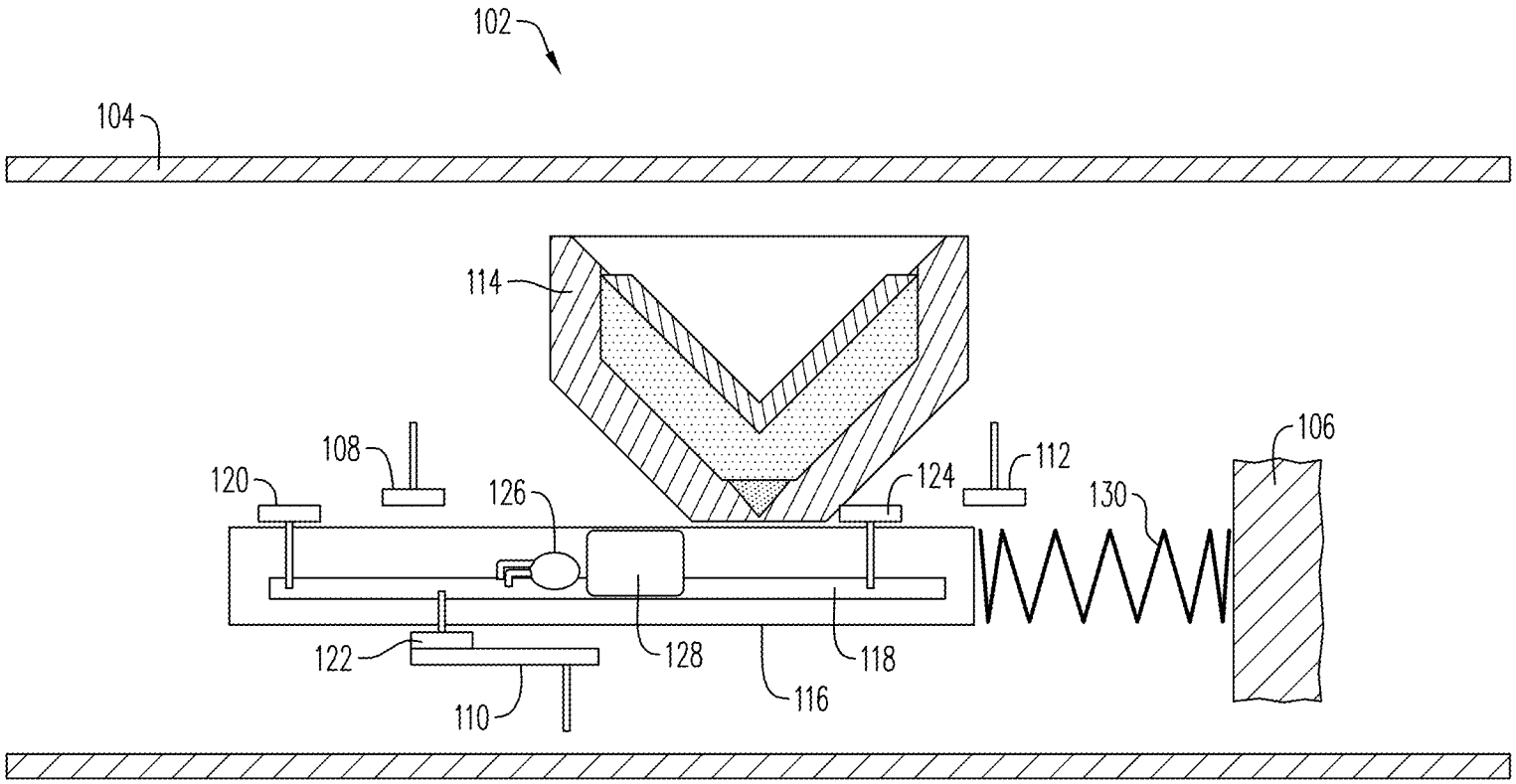
FIG. 1 is a schematic cross-section view of a wellbore tool according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

FIG. 1 shows an exemplary embodiment of a wellbore tool 102. The wellbore tool 102 may include a tool housing 104, an explosive device such as a shaped charge 114 or a detonating cord 404 (see FIG. 4 and FIG. 5) provided within the tool housing 104, an initiator 116 provided within the tool housing 104, and a bias member 130 provided within the tool housing 104.

The wellbore tool 102 may further include an interior surface 106 against which the bias member 130 presses. The interior surface 106 may be part of a holder that holds the shaped charge 114, a holder that holds the initiator 116, or a different surface within the wellbore tool 102. The wellbore tool 102 may further include a tool string signal-in contact 108, a tool string ground contact 110, and a tool string signal-out contact 112. The tool string signal-in contact 108 may provide various control signals to the tool housing 104 as well as supply power for initiating the shaped charge 114 or the detonating cord 404. The tool string ground contact 110 may provide electrical connection to a ground voltage. The tool string signal-out contact 112 may be connected to a through wire to pass various control signals and electrical power further down the tool string to subsequent modules.

The initiator 116 may include a circuit board 118, an initiator signal-in contact 120, an initiator ground contact 122, an initiator signal-out contact 124, a fuse 126, and an initiating charge 128. The circuit board 118 may include integrated circuits and/or surface mounted components. These circuits and/or components may include logical circuits configured for selecting, arming, and initiating various tools in the tool string.

The initiator signal-in contact 120 may be configured to contact the tool string signal-in contact 108 to provide control signals and electrical power to the circuit board 118. The initiator signal-in contact 120 may be a contact type terminal that establishes electrical communication with the tool string signal-in contact 108 via physical contact, i.e., without wires. Alternatively, the initiator signal-in contact 120 may be wired to the tool string signal-in contact 108.

The initiator ground contact 122 may be configured to contact the tool string ground contact 110 to establish a connection to ground, in order to provide a ground for the circuit board 118. The initiator ground contact 122 may be a contact type terminal that establishes electrical communication with the tool string ground contact 110 via physical contact, i.e., without wires. Alternatively, the initiator ground contact 122 may be wired to the tool string ground contact 110.

The initiator signal-out contact 124 may be configured to contact the tool string signal-out contact 112 to establish a connection to the through wire to transmit control signals and electrical power further down the tool string. The initiator signal-out contact 124 may be a contact type terminal that establishes electrical communication with the tool string signal-out contact 112 via physical contact, i.e., without wires. Alternatively, the initiator signal-out contact 124 may be wired to the tool string signal-out contact 112.

The fuse 126 may be connected to the logical circuits on the circuit board 118. Upon receiving the appropriate control signal or sequence of control signals, a voltage may be discharged across the fuse in order to initiate the initiating charge 128.

FIG. 1 shows the wellbore tool 102 in a first configuration in which the the initiating charge 128 is at a ballistically safe distance from the shaped charge 114. The bias member 130 provides a biasing force in a direction away from the interior surface 106 in order to bias the initiator 116 to the first configuration.

FIG. 1 further shows that in the first configuration, the tool string signal-in contact 108 is disconnected from the initiator signal-in contact 120, the tool string ground contact 110 is connected to the tool string signal-out contact 112, and the tool string signal-out contact 112 is disconnected from the initiator signal-out contact 124. However, it will be understood that the disclosure is not limited to this embodiment. For example, the tool string ground contact 110 and the initiator ground contact 122 may be disconnected in the first configuration. Alternatively, the tool string signal-in contact 108 and the initiator signal-in contact 120 may be in electrical communication in the first configuration. Alternatively, the tool string signal-out contact 112 may be in electrical communication with the initiator signal-out contact 124 in the first configuration. In an exemplary embodiment in which electrical contacts are wired instead of relying on physical contact, all corresponding contacts may be in electrical communication in the first configuration.

Figure 2:
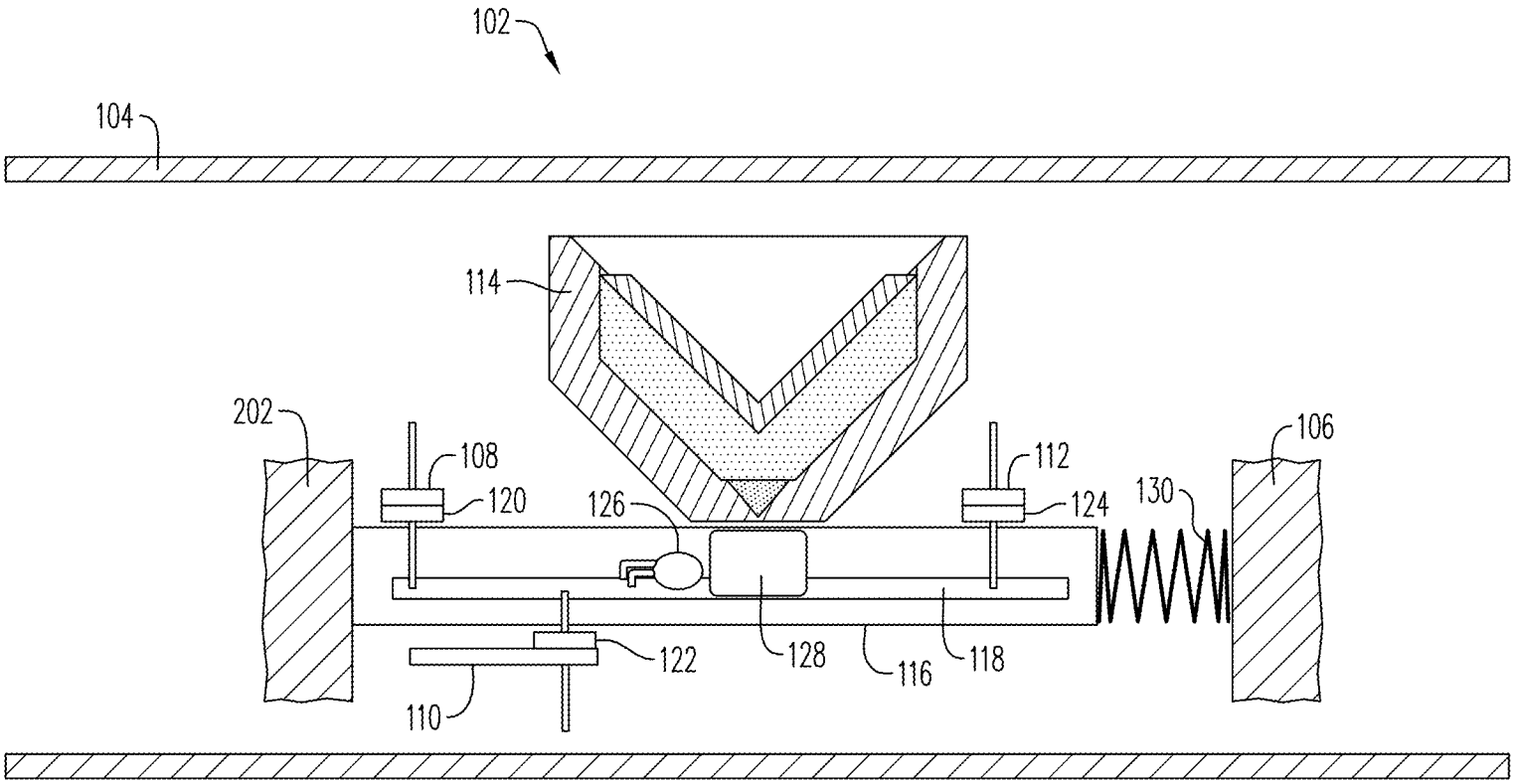
FIG. 2 is a schematic cross-section view of a wellbore tool according to an exemplary embodiment.

In contrast, FIG. 2 shows an exemplary embodiment of the wellbore tool 102 in a second configuration in which the initiator 116 is within a ballistically operable distance from the shaped charge 114. The second configuration may be achieved by applying a coupling force opposite to the bias biasing force of the bias member 130 so as to compress the bias member 130. If the wellbore tool 102 is considered to be a first module in a tool string, the coupling force may be applied by coupling a second module 202 to the wellbore tool 102. By example and not limitation, the second module 202 may include structures such as a tandem sub or tandem seal adapter that extends between and/or connects adjacent perforating guns together, a perforating gun, a weight bar, or any other module that may be found in a wellbore tool string. It will be understood that the representation of the second module 202 in FIG. 2 is schematic only, and is not intended to be limiting regarding the size, shape, or positioning of the second module 202. For example, the second module 202 in FIG. 2 may represent only a part of the second module 202 that protrudes into the tool housing 104. As further seen in FIG. 2, the tool string signal-in contact 108 is in electrical communication with the initiator signal-in contact 120, the tool string ground contact 110 is in electrical communication with the tool string signal-out contact 112, and the tool string signal-out contact 112 is in electrical communication with the initiator signal-out contact 124.

Figure 3A:
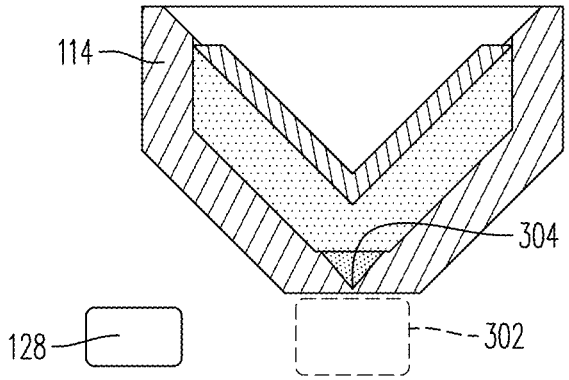
FIG. 3A is a schematic diagram illustrating an initiating charge at a ballistically safe distance according to an exemplary embodiment.

FIG. 3A is a schematic diagram to illustrate the concept of a ballistically safe distance. In an exemplary embodiment, a ballistically safe distance is a distance between the initiating charge 128 and the initiation region 302 of the shaped charge 114 such that an initiation of the initiating charge 128 will not initiate the shaped charge 114. In other words, with a shaped charge 114, there is an initiation region 302 near the apex 304 or initiation point of the shaped charge 114 in which the initiating charge 128 must be positioned in order to initiate the shaped charge 114. If the initiating charge 128 is outside of the initiation region 302, then the initiating charge 128 is at a ballistically safe distance. It will be understood that a similar concept will apply if the explosive device is a detonating cord 404 instead of the shaped charge 114. For example, there will be a region in which the initiating charge 128 must be present in order to initiate the detonating cord 404. Otherwise, the initiating charge 128 will be at a ballistically safe distance.

Figure 3B:
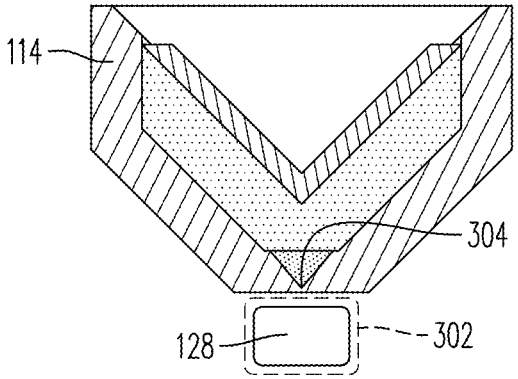
FIG. 3B is a schematic diagram illustrating an initiating charge within a ballistically operable distance of an explosive device according to an exemplary embodiment.

FIG. 3B is a schematic diagram to illustrate the concept of a ballistically operable distance. As seen in FIG. 3B, the initiating charge 128 is positioned within the initiation region 302. At this position, the initiating charge 128 is close enough to the apex 304 of the shaped charge 114 that initiation of the initiating charge 128 will result in initiation of the shaped charge 114.

Figure 4:
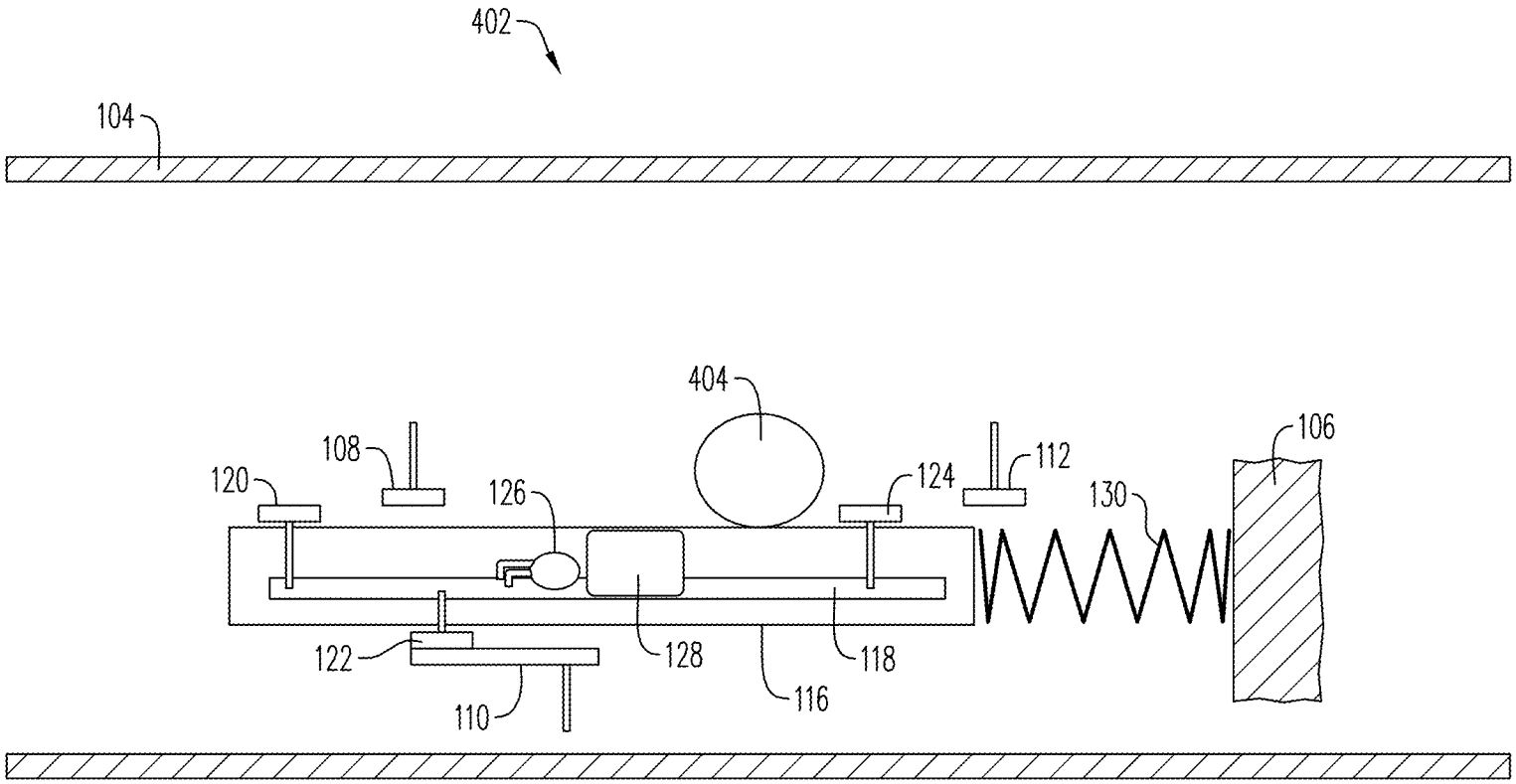
FIG. 4 is a schematic cross-section view of a wellbore tool according to an exemplary embodiment.

FIG. 4 shows an exemplary embodiment of a wellbore tool 402 in which the explosive device is a detonating cord 404 instead of a shaped charge 114. Where FIG. 4 uses identical reference numerals to those used in FIG. 1 and FIG. 2, the corresponding structure and function may be similar to that described above. In FIG. 4, the wellbore tool 402 is in the first configuration. For example, the initiating charge 128 is displaced from the detonating cord 404 and there is a ballistically safe distance between the initiating charge 128 and the detonating cord 404.

Figure 5:
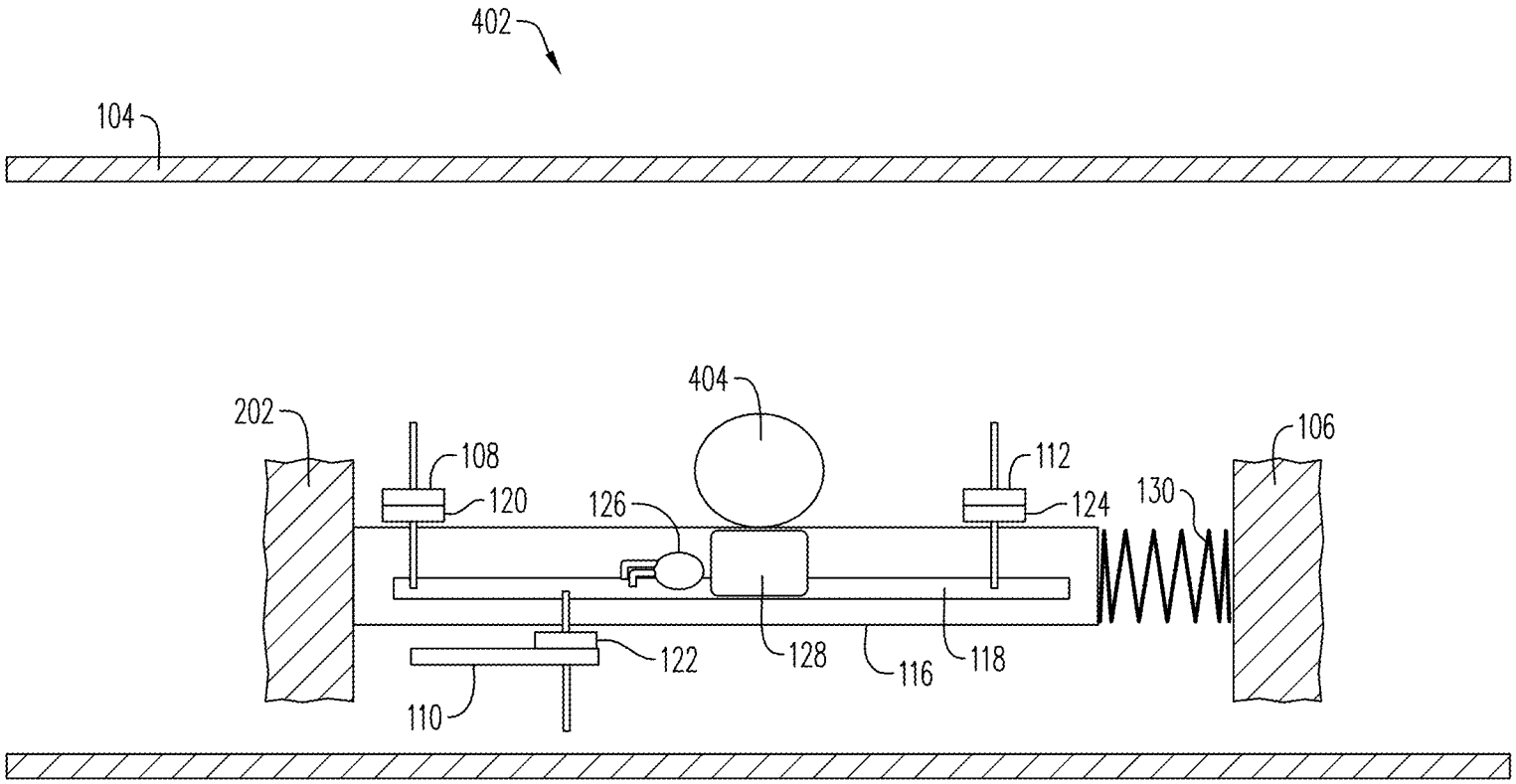
FIG. 5 is a schematic cross-section view of a wellbore tool according to an exemplary embodiment.

In FIG. 5, the wellbore tool 402 is shown in the second configuration after application of a coupling force. For example, the initiating charge 128 is aligned with the detonating cord 404 such that an initiation of the initiating charge 128 would detonate the detonating cord 404. In other words, the initiating charge 128 is within a ballistically operable distance from the detonating cord 404.

Figure 6:
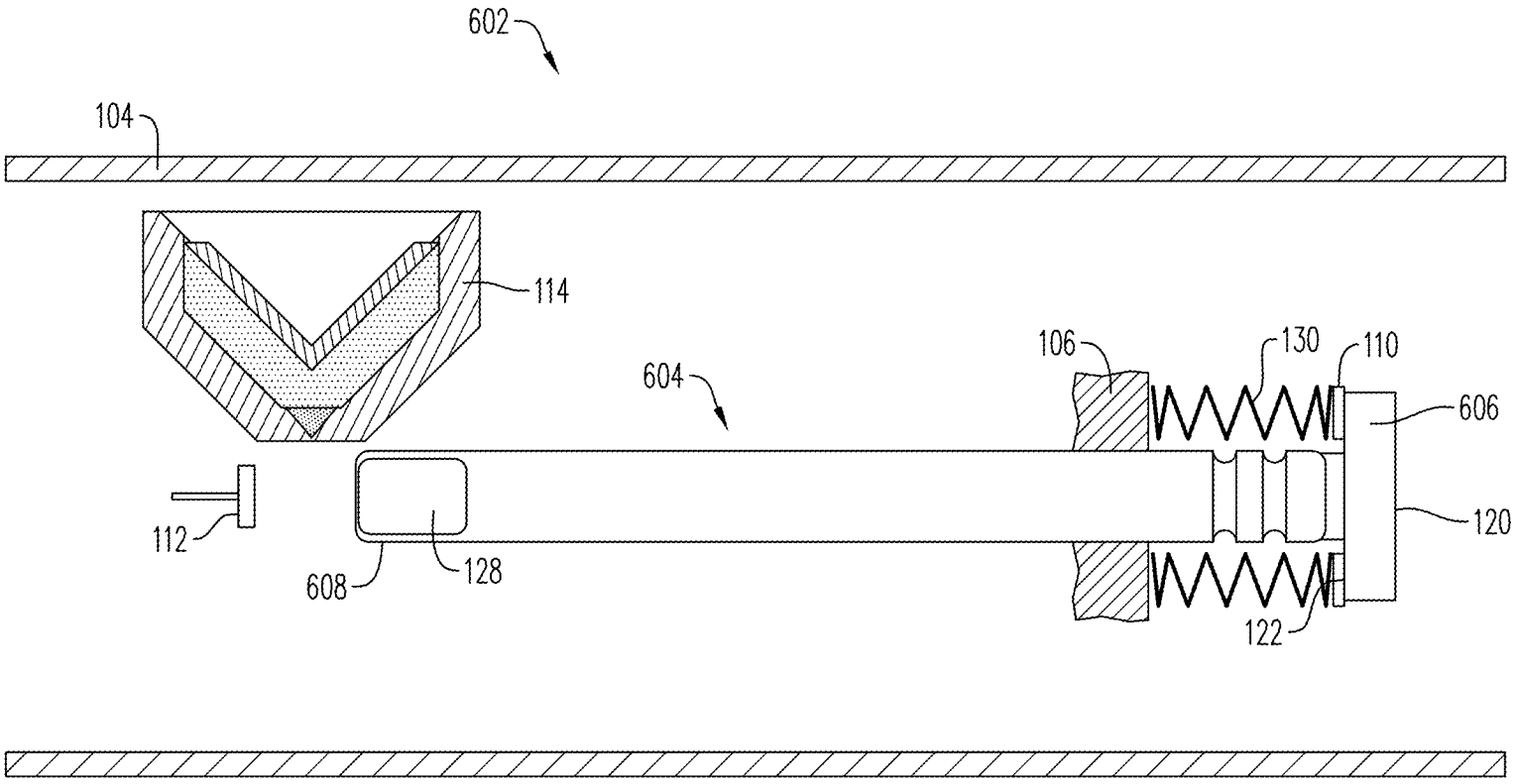
FIG. 6 is a schematic cross-section view of a wellbore tool according to an exemplary embodiment.

FIG. 6 shows an exemplary embodiment of a wellbore tool 602 in which the initiator is a wireless initiator 604. According to an aspect, the wireless initiator 604 includes a detonator or an igniter. The wireless initiator 604 may include an initiator head 606 and an initiator hull 608 extending from the initiator head 606. The initiator head 606 may include the control electronics of the wireless initiator 604 (analogous to the circuit board 118 described with reference to FIG. 1, FIG. 2, FIG. 4, and FIG. 5). The initiator hull 608 may be formed of a conductive material and may include the initiating charge 128 provided therein.

In the embodiment of FIG. 6, the initiator signal-in contact 120 is provided on a first surface of the initiator head 606, and the initiator ground contact 122 is provided on a second surface of the initiator head 606 opposite the initiator signal-in contact 120. The tool string ground contact 110 may be provided on an end of the bias member 130. Alternatively, the bias member 130 itself may be the tool string ground contact. Additionally, if the initiator hull 608 is formed of a conductive material, a portion of the initiator hull 608 may serve as the initiator signal-out contact. An insulating coating or sleeve (not shown) may extend around a portion of the initiator hull 608, while leaving at least one other portion of the initiator hull 608 exposed so that the other portion may serve as the initiator signal-out contact.

In the embodiment of FIG. 6, the wellbore tool 602 is in a first configuration. The bias member 130 has biased the wireless initiator 604 such that the initiating charge 128 is displaced from the shaped charge 114, at a ballistically safe distance from the shaped charge 114.

Figure 7:
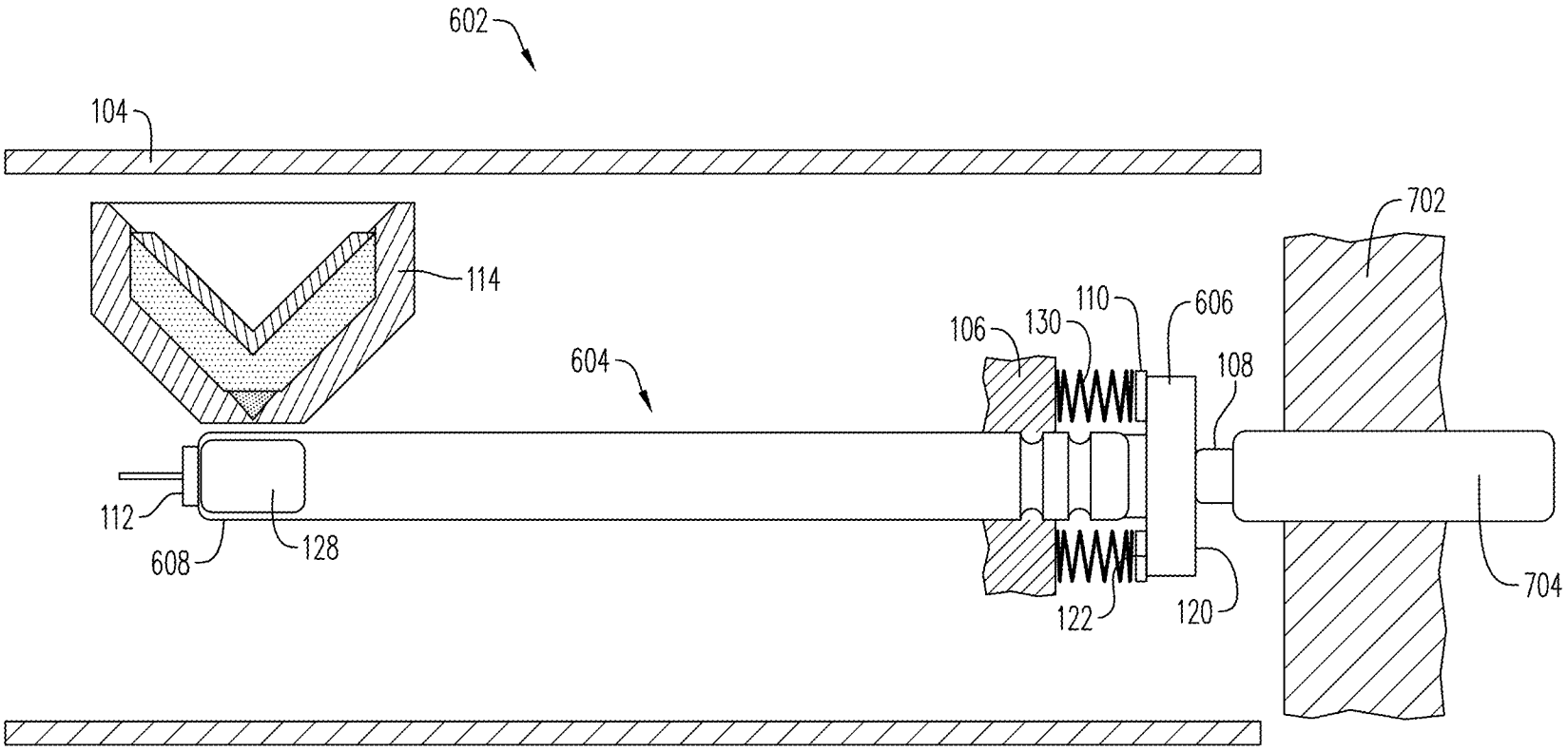
FIG. 7 is a schematic cross-section view of a wellbore tool according to an exemplary embodiment.

In FIG. 7, a second module 702 is coupled to the wellbore tool 602. The second module 702 may be a sub, or, alternatively, the second module 702 may be another wellbore tool such as a perforating gun, a weight bar, or other suitable wellbore tool. The second module 702 may include a bulkhead 704 that provides electrical connectivity between the wellbore tool 602 and the second module 702. The bulkhead 704 may include the tool string signal-in contact 108 that connects with the initiator signal-in contact 120 on the initiator head 606. The tool string signal-in contact 108 provided on the bulkhead 704 may be a fixed pin contact, or alternatively, it may be a spring-loaded pin contact.

Once the second module 702 is coupled to the wellbore tool 602, the wellbore tool 602 is in the second configuration. The bias member 130 has been compressed, allowing the initiator hull 608 to make electrical contact with the tool string signal-out contact 112 and placing the initiating charge 128 at a ballistically operable distance from the shaped charge 114.

In at least an exemplary embodiment, the wireless initiator 604 as shown in FIG. 6 and FIG. 7 may be rotatable relative to the tool housing 104. For example, if the bias member 130 is not affixed to the initiator head 606, then the wireless initiator 604 may freely rotate about its longitudinal axis. Rotation of the wireless initiator 604 may require that the longitudinal axis of the wireless initiator 604 be aligned with the longitudinal axis of the tool housing 104. In contrast, if the initiator is a cartridge-type initiator such as the initiator 116 shown in FIG. 9, then the initiator 116 may be rotationally fixed.

Figure 8A:
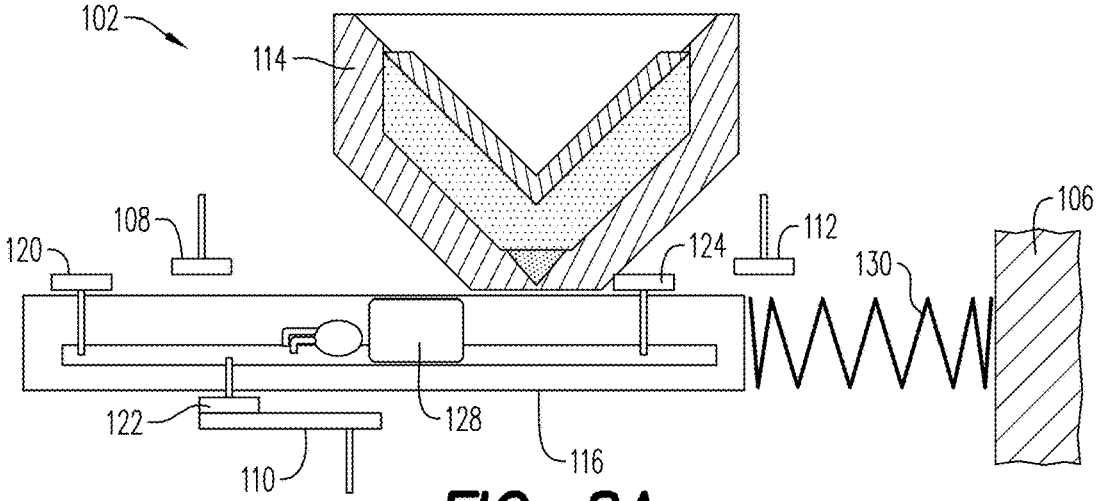
FIG. 8A is a schematic cross-section view of a wellbore tool according to an exemplary embodiment.

At least an exemplary embodiment of the present disclosure may implement the "electric before ballistic arming" (EBBA) safety standard. FIG. 8A shows a first step of an arming procedure. In FIG. 8A, the wellbore tool 102 is both electrically disconnected and ballistically disarmed. For example, the initiator signal-in contact 120 is disconnected from the tool string signal-in contact 108 and the initiator signal-out contact 124 is disconnected from the tool string signal-out contact 112. Additionally, the initiating charge 128 is displaced from the shaped charge 114 at a ballistically safe distance.

Figure 8B:
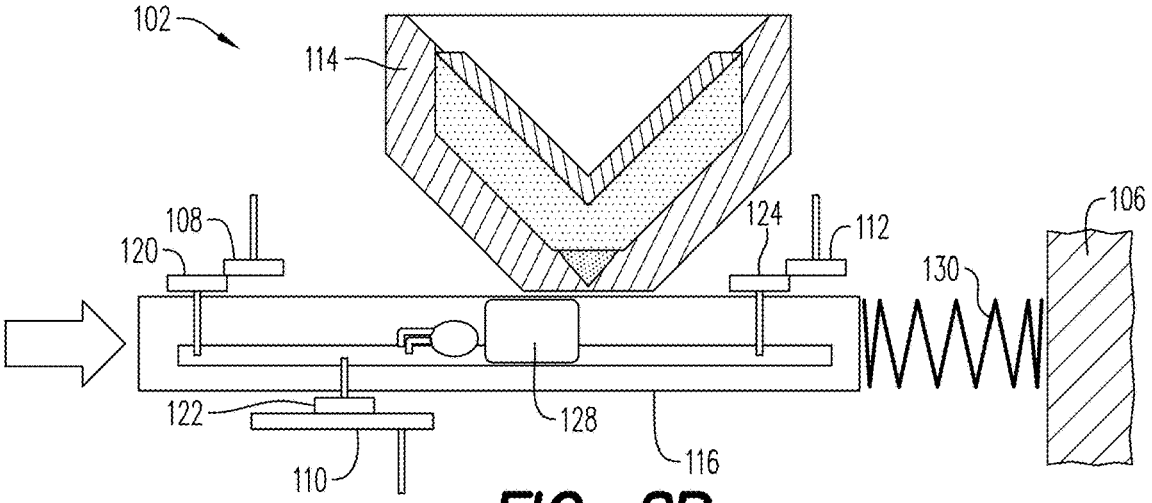
FIG. 8B is a schematic cross-section view of a wellbore tool according to an exemplary embodiment.

FIG. 8B represents an intermediate step as the wellbore tool 102 is coupled to a second module. In other words, a coupling force is being applied against the biasing force of the bias member 130 to begin the transition from the first configuration to the second configuration.

In FIG. 8B, the initiator signal-in contact 120 is in electrical contact with the tool string signal-in contact 108, and the tool string signal-out contact 112 is in electrical contact with the initiator signal-out contact 124, thus establishing electrical contact for the wellbore tool 102. It will be noted, however, that the initiating charge 128 is not yet at a ballistically operable distance from the shaped charge 114, and is instead still displaced from the shaped charge 114. Accordingly, in FIG. 8B, electrical connections have been established before ballistic arming of the wellbore tool 102, thereby satisfying the EBBA standard. It will be noted that it may not be necessary for the tool string signal-out contact 112 to connect to the initiator signal-out contact 124 to satisfy the EBBA standard. For example, all that may be required to satisfy the EBBA standard is for the initiator signal-in contact 120 to be connected to the tool string signal-in contact 108 and for the initiator ground contact 122 to be connected to the tool string ground contact 110.

Figure 8C:
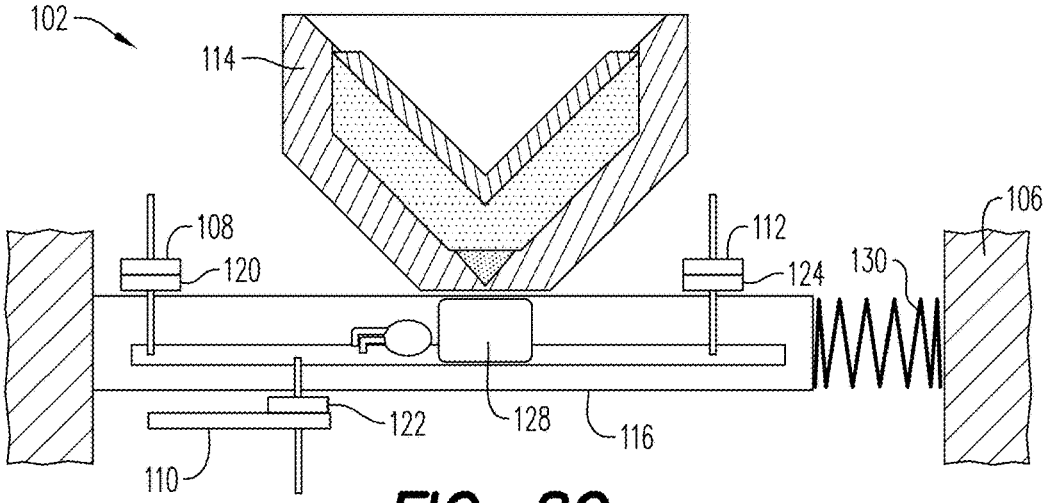
FIG. 8C is a schematic cross-section view of a wellbore tool according to an exemplary embodiment.

In FIG. 8C, the coupling is complete and the wellbore tool 102 is in the second configuration. All electrical connections are connected, and the initiating charge 128 is within a ballistically operable distance from the shaped charge 114. As seen in comparing FIG. 8B to FIG. 8C, electrical arming of the wellbore tool 102 is performed before ballistically arming the first module.

Figure 9:
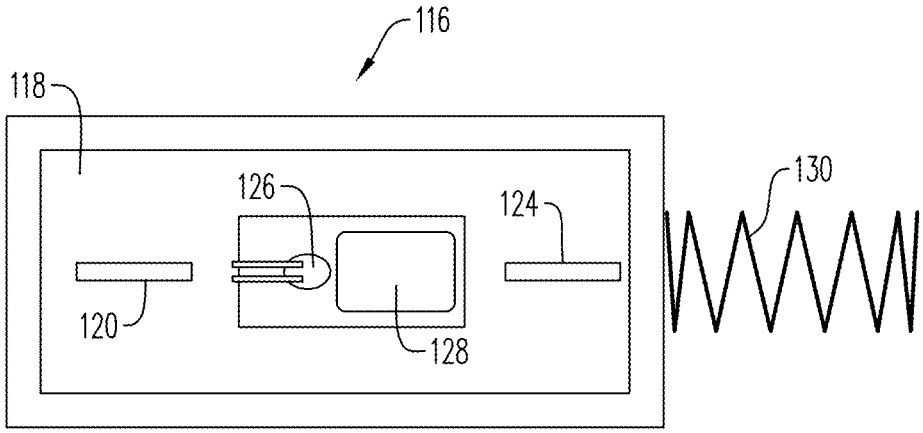
FIG. 9 is a top down view of an initiator according to an exemplary embodiment.

The figures described above show the initiator 116 from a side view. FIG. 9 shows an exemplary embodiment of the initiator 116 from a top-down view, in order to show one possible relative arrangement of the circuit board 118, the initiator signal-in contact 120, the initiator signal-out contact 124, the fuse 126, and the initiating charge 128. In FIG. 9, the initiator ground contact 122 is not shown, as it may be positioned on the underside of the circuit board 118.

In the exemplary embodiments described above, the relative movement between the initiator 116 and the shaped charge 114 is a linear movement, i.e., movement along an axial direction of the wellbore tool 102. However, it will be understood that the embodiment is not limited to this embodiment. For example, in an exemplary embodiment, the initiating charge 128 may be angularly displaced from the initiation region 302. In this embodiment, the initiating charge 128 may be biased to an angularly displaced position by a torsion spring or other similar bias member that exerts a rotational bias force. Accordingly, the transition from the first configuration to the second configuration represents a change in the relative rotational position of the explosive device and the initiator.

Additionally, in the embodiments described above, it is contemplated that the explosive device, such as the shaped charge 114, is in a fixed position relative to the tool housing 104, the initiator 116 moves relative to the tool housing 104. However, it will be understood that the disclosure is not limited to this embodiment. In another exemplary embodiment, the initiator 116 may be fixed relative to the tool housing 104, and the shaped charge 114 may be movable relative to the tool housing 104.

Further, the bias member 130 may be affixed to an internal structure such as the interior surface 106, affixed to the initiator 116, or separate from both the interior surface 106 and the initiator 116. For example, the bias member 130 may be affixed to either of the interior surface 106 and the initiator 116 during the manufacturing process. Alternative, the bias member 130 may be provided separately to be inserted into the tool housing 104 before insertion of the initiator 116.

Additionally, the embodiments above show the initiating charge 128 being put into ballistically operable distance from an explosive device. However, it well be understood that the disclosure is not limited to this embodiment. For example, in an exemplary embodiment, the explosive device may be a booster or an explosive pellet. Alternatively, it may be the booster or the explosive pellet that is being moved relative to the explosive device instead of the initiating charge 128.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while considering that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A ballistically-safe wellbore tool comprising:

an explosive device;

an initiator comprising an initiating charge;

a bias member; and wherein a relative configuration of the explosive device and the initiator is movable between a first configuration, in which the initiating charge is at a ballistically safe distance from the explosive device, and a second configuration, in which the initiating charge is within a ballistically operable distance from the explosive device; and the bias member is configured to bias the explosive device and the initiator to the first configuration;

wherein a relative rotational position of the explosive device and the initiator is changed between the first configuration and the second configuration.

2. The wellbore tool of claim 1, wherein a relative axial position of the explosive device and the initiator is changed between the first configuration and the second configuration.

3. The wellbore tool of claim 1, wherein the explosive device is a detonating cord, a shaped charge, a booster, or an explosive pellet.

4. The wellbore tool of claim 1, further comprising:

a tool string signal-in contact; and a tool string ground contact;

wherein the initiator comprises an initiator signal-in contact and an initiator ground contact;

the tool string signal-in contact, the tool string ground contact, the initiator signal-in contact, and the initiator ground contact are spatially configured such that, in the first configuration, the initiator signal-in contact is electrically disconnected from the tool string signal-in contact and/or the initiator ground contact is electrically disconnected from the tool string ground contact; and the tool string signal-in contact, the tool string ground contact, the initiator signal-in contact, the initiator ground contact, the initiating charge, and the explosive device are spatially configured such that, during a transition from the first configuration to the second configuration, the initiator signal-in contact is in electrical communication with the tool string signal-in contact and the initiator ground contact is in electrical communication with the tool string ground contact before the initiating explosive is within the ballistically operable distance from the explosive device.

5. The wellbore tool of claim 4, further comprising a tool string signal-out contact, wherein:

the initiator comprises an initiator signal-out contact; and in the second configuration, the tool string signal-out contact is in electrical communication with the tool string signal-out contact.

6. The wellbore tool of claim 4, wherein:

the bias member is a spring; and the bias member provides electrical communication between one set of the initiator signal-in contact and the tool string signal-in contact, the initiator ground contact and the tool string ground contact, and the initiator signal-out contact and the tool string signal-out contact.

7. The wellbore tool of claim 1, further comprising a tool housing, wherein:

the explosive device is provided within the tool housing;

the explosive device is in a fixed position relative to the tool housing; and the initiator is movable relative to the tool housing.

8. The wellbore tool of claim 1, further comprising a tool housing; wherein the explosive device is provided within the tool housing;

the explosive device is movable relative to the tool housing; and the initiator is in a fixed position relative to the tool housing.

9. The wellbore tool of claim 1, wherein the bias member is affixed to the initiator.

10. The wellbore tool of claim 1, further comprising an interior surface;

wherein the bias member is affixed to the interior surface.

11. The wellbore tool of claim 1, further comprising an interior surface;

wherein the bias member, the interior surface, and the initiator are separate components such that the bias member is not affixed to either of the interior surface and the initiator.

12. The wellbore tool of claim 1, further comprising an interior surface;

wherein the initiator is rotatable relative to the interior surface.

13. The wellbore tool of claim 1, further comprising an interior surface;

wherein the initiator is in a fixed rotational position relative to the interior surface.

14. A method of arming an explosive device in a wellbore tool, the method comprising:

providing a first module comprising:

an explosive device;

an initiator comprising an initiating charge; and a bias member;

wherein a relative configuration of the explosive device and the initiator is movable between a first configuration, in which the initiating charge is at a ballistically safe distance from the explosive device, and a second configuration, in which the initiating charge is within a ballistically operable distance from the explosive device; and the bias member is configured to bias the explosive device and the initiator to the first configuration via a biasing force; and arming the first module by coupling a second module to the first module;

wherein the arming the first module comprises ballistically arming the first module by providing a coupling force to act against the biasing force such that the explosive device and the initiator transition from the first configuration to the second configuration;

wherein a relative rotational position of the explosive device and the initiator is changed between the first configuration and the second configuration.

15. The method of claim 14, wherein:

one of the first module and the second module comprises a tool string signal-in contact;

one of the first module and the second module comprises a tool string ground contact;

the initiator comprises an initiator signal-in contact and an initiator ground contact;

the arming the first module further comprises electrically arming the first module by establishing electrical communication between the tool string signal-in contact and the initiator signal-in contact and electrical communication between the tool string ground contact and the initiator ground contact; and the electrically arming the first module occurs before the ballistically arming the first module.

16. The method of claim 14, wherein the first module is a first perforating gun and the second module is a second perforating gun.

17. The method of claim 14, wherein the first module is a first perforating gun and the second module is a tandem seal adapter.

18. The method of claim 14, wherein a relative axial position of the explosive device and the initiator is changed between the first configuration and the second configuration.

19. The method of claim 14, wherein:

the first module further comprises a tool housing;

the explosive device is provided within the tool housing;

the explosive device is in a fixed position relative to the tool housing; and the initiator is movable relative to the tool housing.

20. The method of claim 14, wherein:

the first module further comprises a tool housing;

the explosive device is provided within the tool housing;

the explosive device is movable relative to the tool housing; and the initiator is in a fixed position relative to the tool housing.

* * * * *